United States Patent [19]

Sagami

[11] 4,423,950

[45] Jan. 3, 1984

[54] CLEANING DEVICE FOR AN ELECTROPHOTOGRAPHIC REPRODUCING MACHINE

[75] Inventor: Shizuo Sagami, Tokyo, Japan

[73] Assignee: Rank Xerox Limited, London, England

[21] Appl. No.: 355,499

[22] Filed: Mar. 8, 1982

[30] Foreign Application Priority Data

Mar. 18, 1981 [JP] Japan ..... 56-39966

[51] Int. Cl.[3] ..... G03G 15/00; G03G 15/08

[52] U.S. Cl. ..... 355/15; 355/3 DD; 355/14 D; 361/227; 361/233; 118/652

[58] Field of Search ..... 355/15, 3 R, 3 DD, 14 D; 96/1.4; 361/227, 233; 118/652

[56] References Cited

U.S. PATENT DOCUMENTS

| | | | |
|---|---|---|---|
| 3,590,412 | 7/1971 | Gerbasi | 355/15 X |
| 3,655,373 | 4/1972 | Fisher et al. | 355/15 X |
| 3,685,485 | 8/1972 | Kutsuwada et al. | 355/15 X |
| 3,778,678 | 12/1973 | Masuda | 361/233 |
| 3,801,869 | 4/1974 | Masuda | 361/227 |
| 3,872,361 | 3/1975 | Masuda | 361/233 |
| 4,161,765 | 7/1979 | Itoh et al. | 361/227 |
| 4,210,949 | 7/1980 | Masuda | 361/227 |

*Primary Examiner*—A. C. Prescott

[57] ABSTRACT

A cleaning device on an electrophotographic copier uses a toner transport device having a housing with a toner transport device inside and electrode means integral with the periphery of the housing to generate electrostatic waves which affect the toner particles to preclude accumulation in the housing.

14 Claims, 7 Drawing Figures

CLEANING DEVICE FOR AN ELECTROPHOTOGRAPHIC REPRODUCING MACHINE

SCOPE OF THE CLAIM FOR PATENT

A cleaning device for an electronic reproducing machine, wherein a housing 4 is provided around a cleaning brush 3 for cleaning to remove residual toners from the surface of a light sensitive body 1, a three-phase electric field curtain 11 is provided to the inner surface of said housing 4, and at least two three-phase AC voltages having different waveforms or frequencies are applied to said three-phase electric field curtain 11.

DETAILED DESCRIPTION OF THE INVENTION

This invention concerns a cleaning device for an electronic reproducing machine improved with the discharging effect for reclaimed toners.

In conventional electronic reproducing machines, cleaning devices are provided for cleaning to remove toners remained on the surface of a light sensitive body after transfer. Most of such cleaning devices are adapted to remove toners on the surface of the light sensitive body by contacting a cleaning brush or a cleaning blade to the surface of the light sensitive body and, in order to prevent removed toners from stagnating near the brush or blade, the reclaimed toners have usually be collected in a containing section by using a sucking blower or utilizing the pressure of air streams generated upon rotation of the brush. However, the former method is defective in that, if the amount of the suction air is decreased due to the cloggings resulted in the dust collection portion of the blower, the toners are accumulated to the inner surface of the housing, which deposit again on the cleaning brush and the like or scatter to the inside of the reproducing machine main body to contaminate each of the sections therein. The latter method without using blower is also defective since the amount of air streams is extremely small as compared with the former method using blower.

This invention has been made for improving such defects and the object thereof is to provide a cleaning device for an electronic reproducing machine, wherein a three-phase electric field curtain sheet is provided to the inside of a housing in a cleaning device main body and at least two AC voltages having different waveforms or frequencies are applied to the three-phase electric field curtain sheet to form a three-phase electric field curtain on the inside of the housing, so that the reclaimed toners are discharged to the toner containing section while vibrated by the lines of electric force in the electric field curtain, to thereby prevent reclaimed toners from accumulating on the inner surface of the housing.

This invention is to be described more specifically by way of its one embodiment referring to the drawings. In the drawings, reference number 1 represents a light sensitive body of an electronic reproducing machine not shown and reference numeral 2 represents a cleaning device main body for cleaning to remove the toners remained on the surface of the light sensitive body 1 after transfer and the cleaning device has a cleaning brush 3 that rotates in contact with the surface of the light sensitive body 1. The cleaning brush 3 is contained in a cylindrical housing 4 and adapted to convey the toners removed from the surface of the light sensitive body 1 toward a discharge port 4*a* of the housing 4. The discharge port 4*a* is opened to the inside of a reclaimed toner containing section 5. The reclaimed toner containing section 5 comprises, at its inside, a dust collecting roll 6 situated near the discharge port 4*a*, a housing cover 7 situated above the dust collecting roll 6 for covering it and a blade 8 for scraping off the toners deposited on the dust collecting roll 6. The reclaimed toner containing section 5 also comprises, at its upper opening, a filter member 9 for collecting the toners in airs sucked by a blower not shown and, at its bottom, an auger 10 for delivering the reclaimed toners contained in the reclaimed toner containing section 5 to the outside.

While on the other hand, a electric field curtain sheet 11 comprising a plurality of wire-like electrodes 11*a* spaced apart from each other and disposed in the direction crossing to the toner delivering direction is provided to the inner surface of the housing 4. The three-phase electric field curtain sheet 11 has wire-like electrodes 11*a* each, for example, made of a copper foil about 35 in thickness and about 1 mm width embedded in a flexible insulative sheet 11*b*. As shown in FIG. 2, three-phase AC votlages are applied by at least two three-phase AC voltage power sources 12 having different waveforms or frequencies to each of the adjacent wire-like electrodes 11*a*. to form a three-phase electric field curtain on the front and back surfaces of the three-phase electric field curtain sheet 11. In the drawing, reference numeral 13 represents a flicker bar.

The residual toners removed from the surface of the light sensitive body 1 by the cleaning brush 3 are conveyed as the cleaning brush 3 rotates, in which the toners entering the region of the three-phase electric field curtain generated along the inner surface of the housing 4 are vibrated along the lines of the electric force in the three-phase electric field curtain and delivered in the forward direction (in the direction of an arrow A in FIG. 3), that is, toward the discharge port 4*a*. Thus, since the toners are discharged toward the discharge port 4*a* without stagnating on the inner surface of the housing 4 by the delivery force of the cleaning brush 3 and by the delivery force of the three-phase electric field curtain, they do not accumulate on the inner surface of the housing 4 at all. This enables most of the toners removed from the light sensitive body 1 by the cleaning brush 3 to be reclaimed into the reclaimed toner containing section 5. While the cleaning brush 3 is rotated only during the copying operation of the reproducing machine, it is preferred to apply the three-phase AC voltage to each of the wire-like electrodes 11*a* of the electric field curtain sheet 11 as soon as the power source for the reproducing machine is turned ON. Further, while the electric field curtain can generally be formed also by the application of single-phase AC voltages, the application of three-phase AC voltages provides better effects for the prevention of toner deposition or accumulation. Furthermore, the toner delivery effect can be increased more by the superimposition of two three-phase AC voltages having different frequencies or waveforms, for example, with reversed order of phase to form ununiform electric field of beat progressive waveforms rather than applying the three-phase AC voltages having some frequency waveform. For instance, by applying three-phase AC voltages having different waveforms as shown in FIG. 4(*a*) to the electric field sheet 11, the toners are proceeded in the direction of the arrow while vibrating along a star-like trace as shown in FIG. 4(*b*). Alternatively, by applying three-phase AC voltages of different frequencies as shown in FIG. 5(*a*) the toners are proceeded in the direction of the arrow while vibrating along a trace like that of the flappings of bird wings as shown in FIG. 5(*b*).

As described specifically above, according to this invention, since a three-phase electric field sheet is provided to the inner surface of a housing surrounding the periphery of a cleaning brush and at least two three-phase AC voltages having different frequencies or waveform are applied to the three-phase electric field sheet to form an electric field curtain, the toners near the inner surface of the housing are positively delivered by the lines of electric force in the electric field curtain toward a reclaimed toner containing section, whereby the toners do not deposit or accumulate to the inner surface of the housing even if the blower suction force or the pressure of air streams generated by the rotation of the cleaning rush is reduced. This can surely prevent the stains on copy sheets or contamination in the reproducing machine caused by the re-deposition of the accumulated toners to the cleaning brush.

BRIEF DESCRIPTION OF THE DRAWINGS

The drawings show one embodiment of this invention, wherein.

Figure 1:
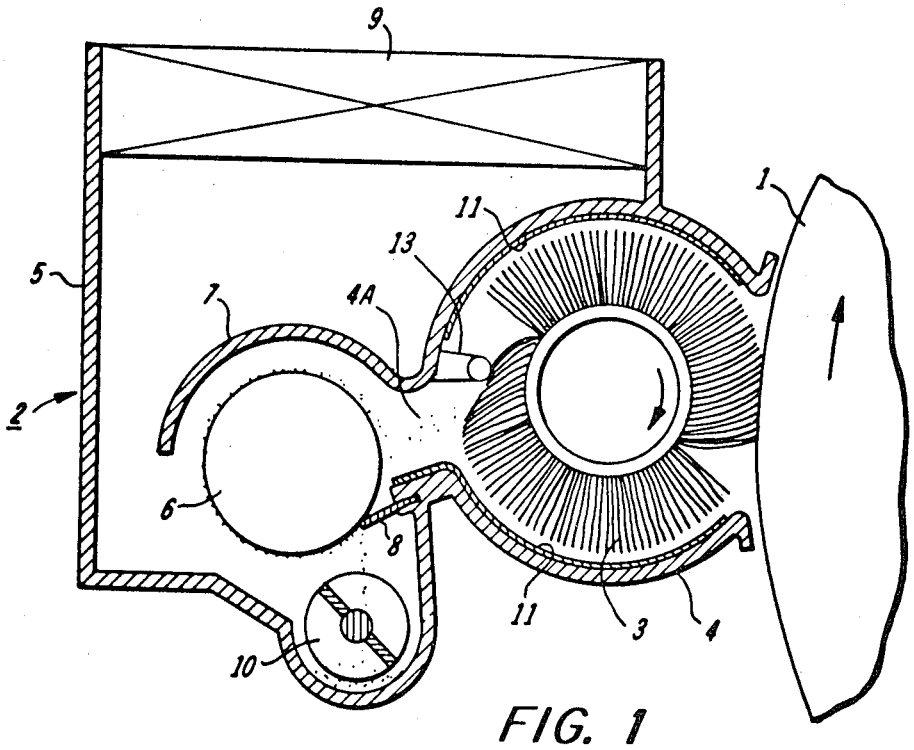
FIG. 1 is a cross sectional view of the invention.
Figure 2:
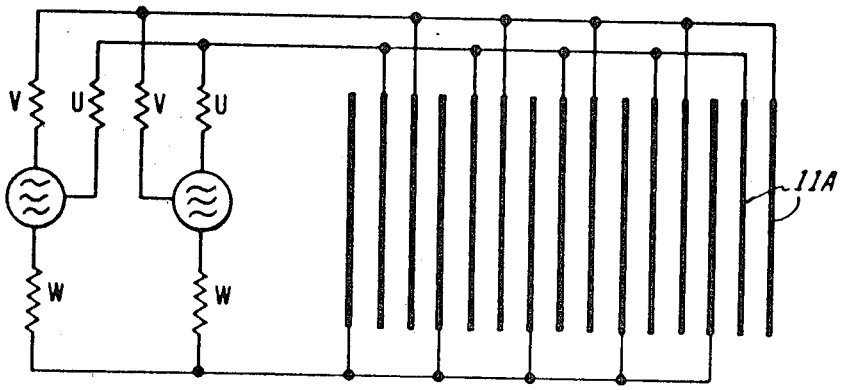
FIG. 2 is an explanatory view for the arrangement of wire-like electrodes.
Figure 3:
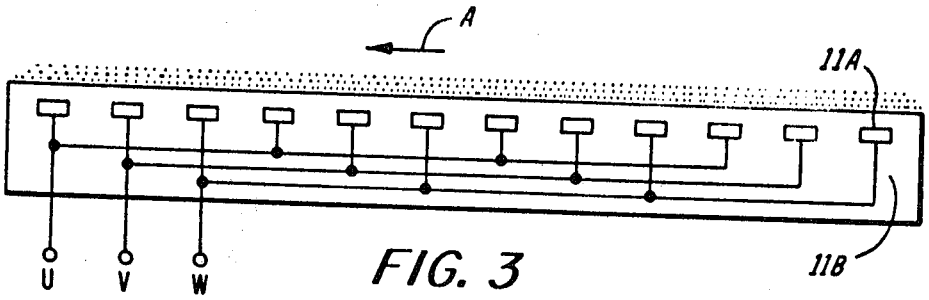
FIG. 3 is an explanatory view for the operation thereof.
Figure 4A:
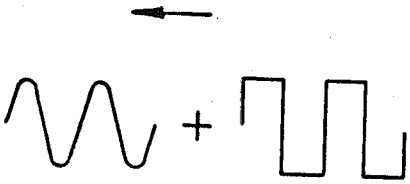
FIGS. 4(*d*), (*b*) and FIGS. 5(*a*), (*b*) are explanatory views showing the vibrations of the toners resulted depending on the types of application voltages.
Figure 4B:
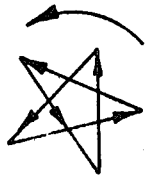
Figure 5A:
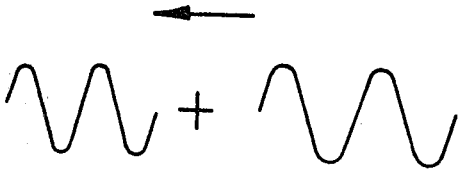
Figure 5B:
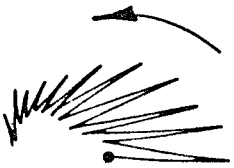

What is claimed is:

1. Toner transport apparatus for use in the process of xerography, said apparatus comprising:

a generally cylindrical housing having a first opening in the periphery thereof:

a toner transport member partially disposed in said housing and protruding through said opening for contact with toner to be transported;

means disposed internally of said housing and adapted to prevent toner from accumulating on the periphery of said housing and cooperating with said toner transport member for conveying toner adjacent the periphery of said housing away from said first opening; said housing having a second opening in the periphery thereof, said means disposed internally of said housing and said transport member being adapted to deliver said toner to said second opening where it can be removed from said housing.

2. A cleaning device for removing residual toner from a light sensitive body used in xerographic reproducing apparatus, said device comprising:

a generally cylindrical housing having first and second elongated openings in the periphery thereof;

a brush structure supported for rotation in said housing and partially extending through said first elongated opening for contacting said light sensitive body for removing toner therefrom and transporting it away from said first opening;

means integral with the periphery of said housing for generating travelling electrostatic waves which travel away from said first opening whereby toner particles not transported by said brush structure are precluded from accumulating on said periphery and are transported away from said first opening and delivered to said second opening.

3. Apparatus according to claim 1, wherein said means adapted to prevent toner from accumulating on said periphery comprises means for generating travelling electrostatic waves.

4. Apparatus according to claim 3 wherein said means for generating traveling electrostatic waves comprises a plurality of electrodes connected to two A.C. voltage sources having different waveforms.

5. Apparatus according to claim 3 wherein said means for generating travelling electrostatic waves comprises a plurality of electrodes connected to two A.C. voltage sources having different frequencies.

6. Apparatus according to claims, 3, 4 or 5 including a reclaimed toner section for receiving toner through said second opening and means disposed in said reclaimed toner section for filtering toner from air circulated through said generally cylindrical housing and said reclaimed toner section.

7. Apparatus according to claim 6 including an auger disposed in said reclaimed toner section.

8. Apparatus according to claim 2 wherein said means for generating travelling electrostatic waves comprises two A.C. voltage sources having different waveforms.

9. Apparatus according to claim 2 wherein said means for generating travelling electrostatic waves comprises two A.C. votlage sources having different frequencies.

10. Apparatus according to claims 2 or 8 including a reclaimed toner section for receiving toner through said second elongated opening and means disposed in said reclaimed toner section for filtering toner from air circulated through said generally cylindrical housing and said reclaimed toner section.

11. Apparatus according to claim 4 wherein said voltage sources are three-phase sources.

12. Apparatus according to claim 5 wherein said voltage sources are three-phase.

13. Apparatus according to claim 11 wherein each electrode is connected to each of said A.C. voltage sources.

14. Apparatus according to claim 11 wherein each electrode is connected to each of said A.C. voltage sources.

* * * * *